US011269264B2

(12) United States Patent
Yamauchi et al.

(10) Patent No.: US 11,269,264 B2
(45) Date of Patent: Mar. 8, 2022

(54) PRINTING APPARATUS USING IMAGE FORMING UNITS ACCOMMODATING THE SAME COLOR

(71) Applicant: FUJIFILM BUSINESS INNOVATION CORP., Tokyo (JP)

(72) Inventors: Shoji Yamauchi, Kanagawa (JP); Yoshihisa Nakao, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/984,841

(22) Filed: Aug. 4, 2020

(65) Prior Publication Data

US 2021/0294254 A1 Sep. 23, 2021

(30) Foreign Application Priority Data

Mar. 23, 2020 (JP) ..... JP2020-050411

(51) Int. Cl.
*G03G 15/01* (2006.01)
*B41J 2/21* (2006.01)
*G03G 15/00* (2006.01)

(52) U.S. Cl.
CPC ..... *G03G 15/0121* (2013.01); *B41J 2/21* (2013.01); *G03G 15/0131* (2013.01); *G03G 15/0178* (2013.01); *G03G 15/5041* (2013.01); *G03G 2215/00063* (2013.01)

(58) Field of Classification Search
CPC ..... G03G 15/0178; G03G 15/0121; G03G 2215/0103; B41J 2/21; B41J 2/525
USPC ..... 399/54, 223; 347/84, 115
See application file for complete search history.

(56) References Cited

U.S. PATENT DOCUMENTS

2005/0036798 A1* 2/2005 Mochizuki ..... G03G 15/0822 399/44
2006/0110176 A1* 5/2006 Sekiguchi ..... G03G 15/0121 399/53
2007/0122197 A1* 5/2007 Schulze-Hagenest ..... G03G 15/6529 399/223
2007/0122198 A1* 5/2007 Sakatani ..... G03G 15/0126 399/223
2008/0240788 A1* 10/2008 Mashtare ..... G03G 15/0121 399/223
2010/0014893 A1* 1/2010 Lange ..... G03G 15/1605 399/223
2012/0237235 A1* 9/2012 Banton ..... G03G 15/0126 399/54

FOREIGN PATENT DOCUMENTS

JP 01307778 A * 12/1989
JP H08-286475 A 11/1996
JP 09090701 A * 4/1997
JP 10301358 A * 11/1998
JP 11334151 A * 12/1999
JP 2003-140431 A 5/2003
JP 2005201990 A * 7/2005 ..... G06K 15/129
JP 2008003406 A * 1/2008
JP 2010014776 A * 1/2010
JP 2015-007736 A 1/2015

* cited by examiner

*Primary Examiner* — Robert B Beatty
(74) *Attorney, Agent, or Firm* — Oliff PLC

(57) ABSTRACT

A printing apparatus includes: plural image forming units accommodating colorants of the same color; and a controller that forms an image of one color using the plural image forming units.

8 Claims, 16 Drawing Sheets

PRINTING APPARATUS USING IMAGE FORMING UNITS ACCOMMODATING THE SAME COLOR

CROSS-REFERENCE TO RELATED APPLICATIONS

This application is based on and claims priority under 35 USC 119 from Japanese Patent Application No. 2020-050411 filed Mar. 23, 2020.

BACKGROUND

1. Technical Field

The present disclosure relates to a printing apparatus.

2. Related Art

JP-A-8-286475 describes an electrophotographic color image forming apparatus including a yellow image forming unit, a magenta image forming unit, a cyan image forming unit, and two black image forming units that are arranged side by side. One of the two black image forming units contains black toner having a high degree of coloration, and the other contains black toner having a low degree of coloration.

JP-A-2015-7736 describes an image forming apparatus for forming an image with two chromatic colors including black and red based on image data. The image forming apparatus includes a determination unit and a processor. In forming an image, the determination unit determines whether a valid dot of an achromatic toner and a valid dot of the chromatic toner overlap each other. When the determination results shows that the valid dot of the achromatic toner and the valid dot of the chromatic color overlap each other, the processor invalidates the valid dot of the chromatic color.

SUMMARY

Aspects of non-limiting embodiments of the present disclosure relate to reducing toner consumed in a toner band for preventing a failure of an image carrier.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a printing apparatus including: plural image forming units accommodating colorants of the same color; and a controller that forms an image of one color using the plural image forming units.

BRIEF DESCRIPTION OF THE DRAWINGS

Exemplary embodiment(s) of the present disclosure will be described in detail based on the following figures, wherein.

DETAILED DESCRIPTION

Next, an exemplary embodiment and examples will be described in more detail with reference to the accompanying drawings. It is noted that the present disclosure is not limited to the exemplary embodiment and the examples.

It is also noted that in the following description made with reference to the accompanying drawings, the drawings are schematic and ratios of dimensions or the like of elements are different from actual ones. Illustration of elements and members other than those necessary for the description may be omitted as appropriate for the sake of easy understanding.

EXEMPLARY EMBODIMENT

(1) Overall Configuration and Operation of Image Forming Apparatus

Figure 1:
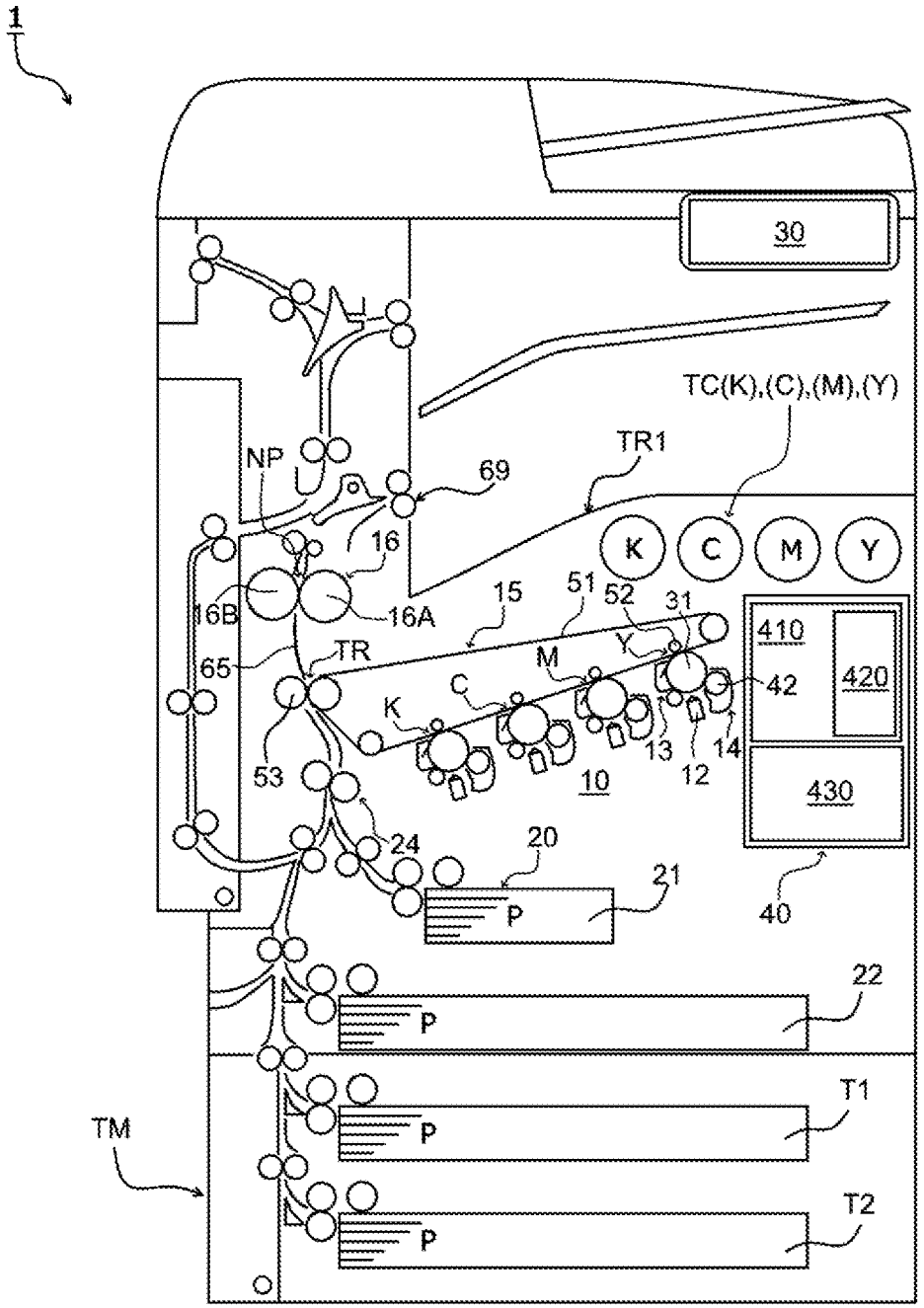
FIG. 1 is a schematic cross-sectional view illustrating an overall configuration of an image forming apparatus.
Figure 2:
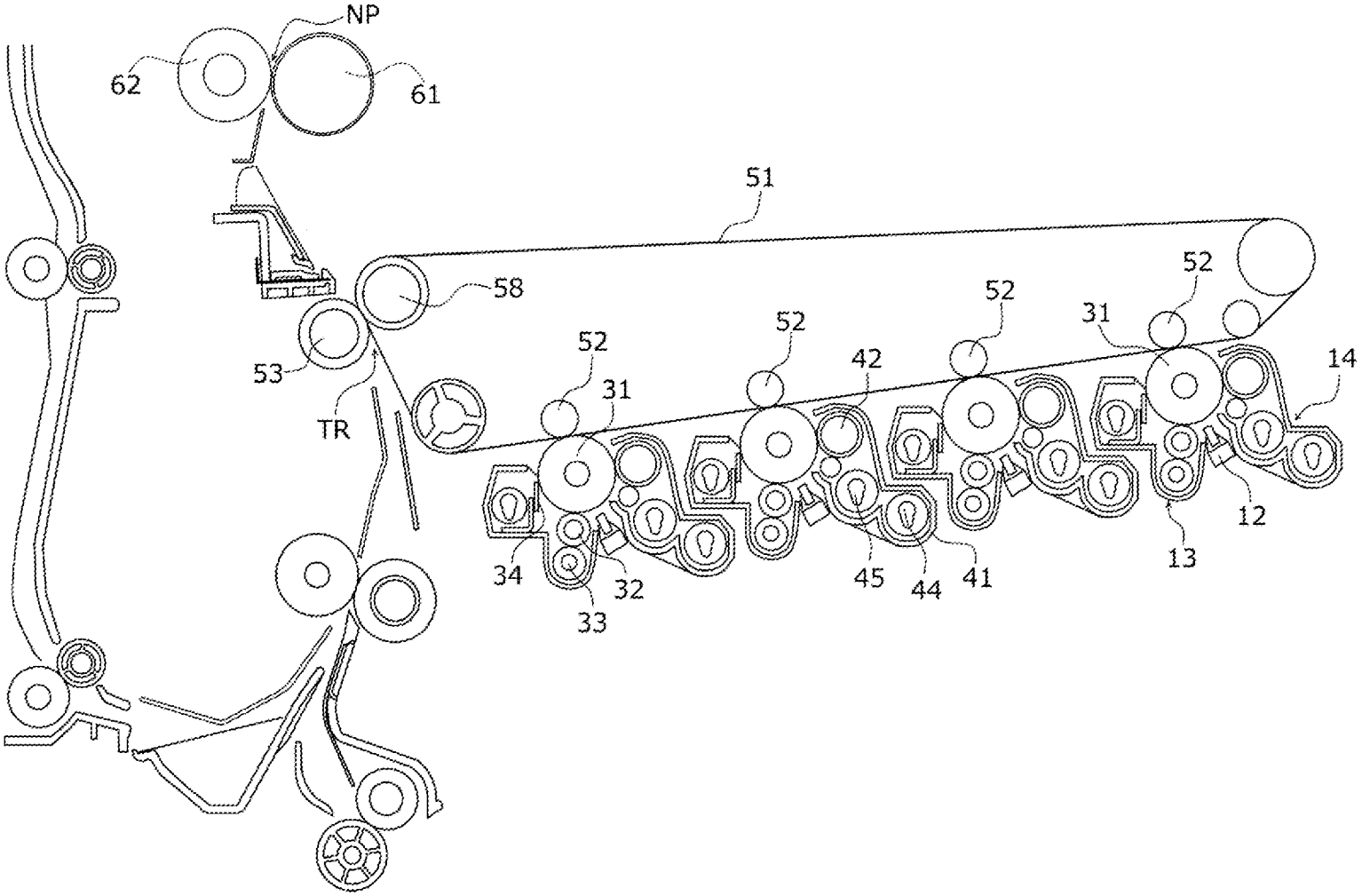
FIG. 2 is a schematic cross-sectional view illustrating an internal configuration of an image forming device in the image forming apparatus.

FIG. 1 is a schematic cross-sectional view illustrating an overall configuration of an image forming apparatus 1 according to an exemplary embodiment. FIG. 2 is a schematic cross-sectional view illustrating an internal configuration of an image forming device 10.

The overall configuration and operation of the image forming apparatus 1 will be described below with reference to the accompanying drawings.

(1.1) Overall Configuration of Image Forming Apparatus

The image forming apparatus 1 includes the image forming device 10, a sheet feeding device 20 attached to a bottom portion of the image forming device 10, an operation display 30, and a control device 40.

The image forming apparatus 1 is an example of a printing apparatus. The printing apparatus may be implemented by an apparatus other than the image forming apparatus 1. For example, a powder coating apparatus that uses a developer of the exemplary embodiment and examples as coating powder is an example of a printing apparatus.

Specifically, the developing device 14 of the exemplary embodiment is used as a powder coating head (which is an example of a powder supply device) for use in electrostatic powder coating. A conductive sheet-shaped medium is transported near the powder coating head. When a bias voltage is applied between the powder coating head and the conductive sheet-shaped medium, charged coating powder (for example, thermosetting toner) is applied onto the sheet-shaped medium. Then, the sheet-shaped medium is heated, so that the surface of the sheet-shaped medium is coated.

Figure 3:
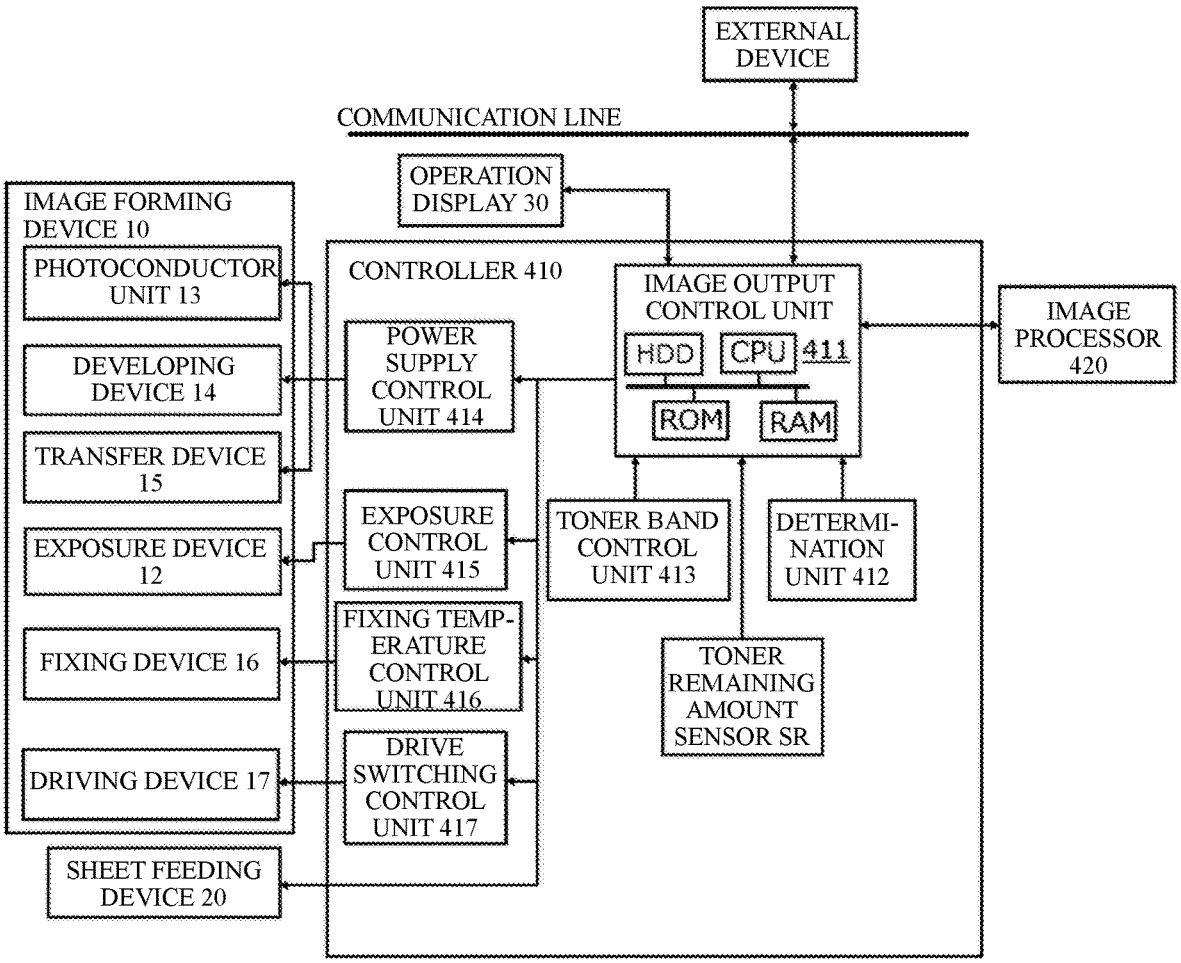
FIG. 3 is a block diagram illustrating an example of a functional configuration of the image forming apparatus.

The image forming device 10 includes exposure devices 12, photoconductor units 13, the developing devices 14, a transfer device 15, a fixing device 16, and a driving device 17 (see FIG. 3). The developing device 14 is an example of a powder supplying unit. The image forming device 10 forms a toner image on a sheet P fed from the sheet feeding device 20 based on image information. In this exemplary embodiment, the photoconductor unit 13 and the developing device 14 are paired to constitute an image forming unit (which may be referred to as an "image formation engine").

The sheet feeding device 20 including sheet trays 21, 22 is disposed at a bottom portion of the image forming device 10. A tray module TM is disposed below the sheet feeding device 20. The tray module TM includes multiple (two in this exemplary embodiment) sheet trays T1, T2 that are stacked in up and down directions. The sheet trays T1, T2 accommodate sheets P. The tray module TM is connected to the image forming device 10 and feeds the sheets P to the image forming device 10.

The sheet feeding device 20 includes plural trays that accommodate sheets of different types (for example, different materials, thicknesses, sheet sizes, or grain sizes). The sheet feeding device 20 supplies the sheet fed out from any one of the trays to the image forming device 10.

The operation display 30 corresponds to a so-called user interface. Specifically, the operation display 30 is implemented by a combination of a liquid crystal display panel, various operation buttons, and a touch panel. The operation display 30 is used for an operator to input various settings and instructions and displays information.

The control device 40 includes a controller 410, an image processor 420, and a power supply device 430. The controller 410 controls the operation of the image forming apparatus 1. The image processor 420 operates under the control of the controller 410. The power supply device 430 applies voltages to charging rollers 32, developing rollers 42, primary transfer rollers 52, and a secondary transfer roller 53 (which will be described later). The developing rollers 42 are an example of powder supply rollers.

The image processor 420 converts print information input from an external device (for example, a personal computer) into image information for formation of a latent image, and outputs drive signals to the exposure devices 12 at a preset timing. The exposure device 12 of the present exemplary embodiment includes a light emission diode (LED) head in which LEDs are arranged linearly.

(1.2) Configuration and Operation of Image Forming Device 10

In the image forming apparatus 1 having the configuration described above, the sheet P which is fed out from one of the trays (in the sheet feeding device 20 or the tray module TM) designated by a print job for each sheet to be printed is sent to the image forming device 10 in accordance with timing of image formation.

The photoconductor units 13 are located above the sheet feeding device 20 (that is, in a z direction with respect to the sheet feeding device 20) and arranged side by side. Each photoconductor unit 13 includes a photoconductor drum 31 that is driven by the driving device (see FIG. 3) to rotate. The charging roller 32, the exposure device 12, the developing device 14, the primary transfer roller 52, and a cleaning blade 34 are arranged along a rotation direction of the photoconductor drum 31. A cleaning roller 33 is in contact with the charging roller 32. The cleaning roller 33 cleans the surface of the charging roller 32.

The developing device 14 has a developing housing 41. The developing housing 41 accommodates a developer containing a colorant and a carrier. In the developing housing 41, the developing roller 42 and a pair of augers 44, 45 are provided. The developing roller 42 faces the photoconductor drum 31. The developing roller 42 is driven by the driving device 17 (see FIG. 3) to rotate. The developing roller 42 is an example of the powder supplying roller. The augers 44 and 45 are disposed in rear of and obliquely below the developing roller 42. The augers 44 and 45 agitate and transport the developer toward the developing roller 42.

The developing devices 14 have substantially the same configuration except developers accommodated in the developing housings 41. The developing devices 14 form toner images with toners of yellow (Y), magenta (M), cyan (C), and black (K), respectively. The toners of yellow (Y), magenta (M), cyan (C), and black (K) are examples of the colorant. Each of the developing devices 14 accommodates a toner of a specific color as a colorant and forms a toner image of the respective one of the specific colors. For example, two of the four developing devices 14 accommodate the specific color toners, and the remaining two developing devices 14 accommodate the black toner. In this case, a two-color image of the specific color and black is formed. Alternatively, the four developing device 14 accommodate the toner of the same color. In this case, a single-color image is formed.

Replaceable toner cartridges TC(K), (C), (M), and (Y) and toner supply devices (not illustrated) are disposed above the developing devices 14. The toner cartridges TC(K), (C), (M), and (Y) accommodate the toners (which are an example of the colorants). Each toner supply device supplies the toner and the carrier from a respective one of the toner cartridges TC to a respective one of the developing devices 14. An IC tag (not illustrated) is mounted on the toner cartridge TC. For example, the IC tag stores identification information including toner color information, and usage history information. A toner remaining amount sensor SR (see FIG. 3) is also mounted on the toner cartridge TC. The toner remaining amount sensor SR detects the amount of remaining toner in the toner cartridge TC and detects a replacement timing of the toner cartridge TC.

The developing device 14, the toner cartridge TC, and the toner supply device may be detachably attached to the photoconductor unit 13 as an image formation engine for each color. The developing device 14, the toner cartridge TC, and the toner supply device may be replaced with another developing device 14, another toner cartridge TC, and another toner supply device. One of the photoconductor units 13 may be replaced with another one of the photoconductor units 13.

The surface of the rotating photoconductor drum 31 is charged by the charging roller 32. An electrostatic latent image is formed on the charged surface of the photoconductor drum 31 by latent image formation light emitted from the exposure device 12. The electrostatic latent image formed on the photoconductor drum 31 is developed into a toner image by the developing roller 42.

The transfer device 15 includes an intermediate transfer belt 51, the primary transfer rollers 52, and the secondary transfer roller 53. The toner images of the respective colors formed on the photoconductor drums 31 of the photoconductor units 13 are transferred onto the intermediate transfer belt 51 in a superimposed manner. The primary transfer rollers 52 sequentially transfer (primarily transfer) the toner images of the respective colors formed by the photoconductor units 13 onto the intermediate transfer belt 51. The secondary transfer roller 53 collectively transfers (secondarily transfers) the toner images of the respective colors, which are transferred onto the intermediate transfer belt 51 in the superimposed manner, onto the sheet P.

The toner images of the respective colors formed on the photoconductor drums 31 of the photoconductor units 13 are sequentially electrostatically transferred (primarily transferred) onto the intermediate transfer belt 51 by the primary transfer rollers 52 to which a predetermined transfer voltage is applied from the power supply device 430 which is controlled by the controller 410, so that the superimposed toner image is formed in which the toner images of the respective colors are formed.

As the intermediate transfer belt 51 moves, the superimposed toner image on the intermediate transfer belt 51 is transported to a region (secondary transfer portion TR). In the secondary transfer portion TR, the secondary transfer roller 53 is disposed. The sheet P is supplied from the sheet feeding device 20 to the secondary transfer portion TR according to timing at which the superimposed toner image is transported to the secondary transfer portion TR. The predetermined transfer voltage is applied to the secondary transfer roller 53 from the power supply device 430 which is controlled by the controller 410. The superimposed toner image on the intermediate transfer belt 51 is collectively transferred onto the sheet P that is delivered by a pair of registration rollers 24 and guided by a transport guide.

Residual toner on the surface of the photoconductor drum 31 is removed by the cleaning blade 34 and collected in a waste toner container (not illustrated). The surface of the photoconductor drum 31 is re-charged by the charging roller 32. Residual matters that have not been removed by the cleaning blade 34 but still adhere to the charging roller 32 is captured by the surface of the cleaning roller 33 which rotates in contact with the charging roller 32.

The fixing device 16 includes a heating module 16A and a pressure module 16B. A fixing nip portion NP (fixing region) is formed by a pressure contact region between the heating module 16A and the pressure module 16B. The sheet P on which the toner image is transferred in the secondary transfer portion TR is transported to the fixing device 16 via a transportation guide 65 in a state in which the toner image is unfixed. The toner image is fixed to the sheet P transported to the fixing device 16 by the action of heating and pressurizing by the pair of the heating module 16A and the pressure module 16B.

The sheet P on which the fixed toner image is formed is guided by a transport guide, and is discharged from a pair of discharge rollers 69 to a discharge tray TR1 on an upper surface of the image forming apparatus 1.

(2) Functional Configuration and Operation of Image Forming Apparatus 1

Figure 4:
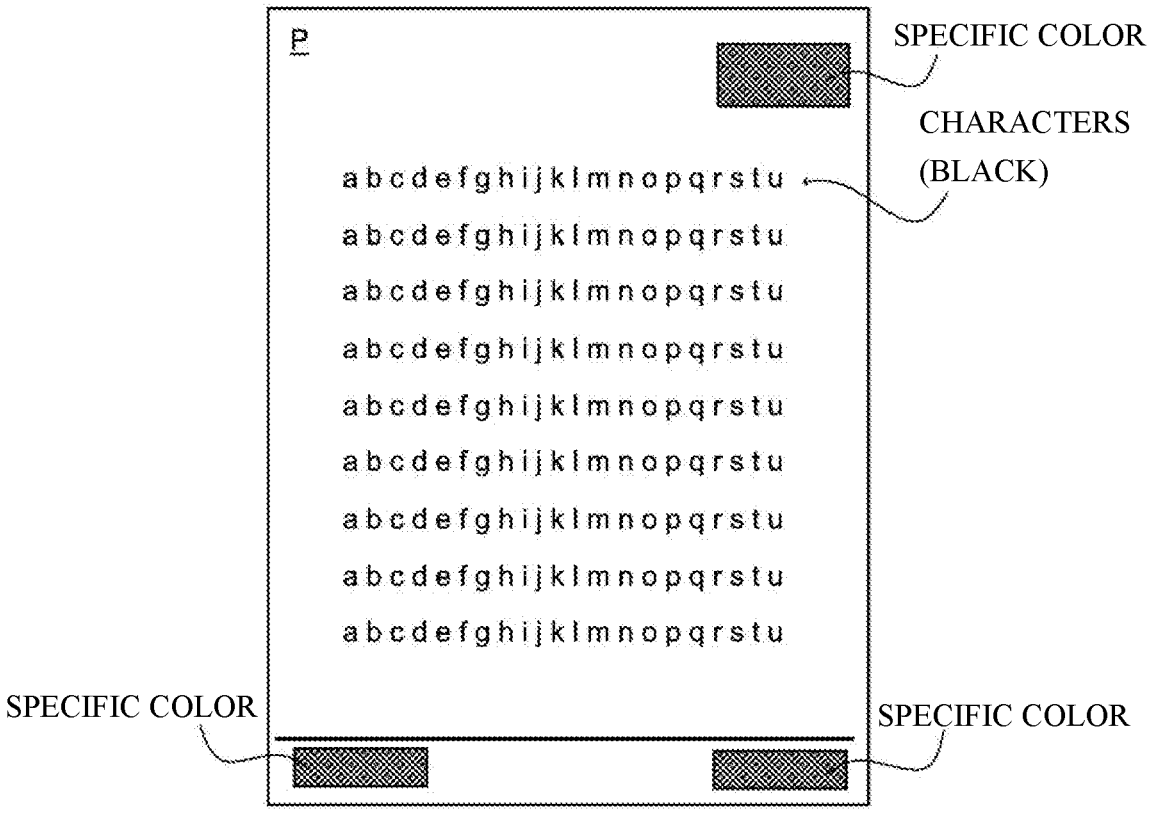
FIG. 4 is a diagram illustrating specific color printing.
Figure 5:
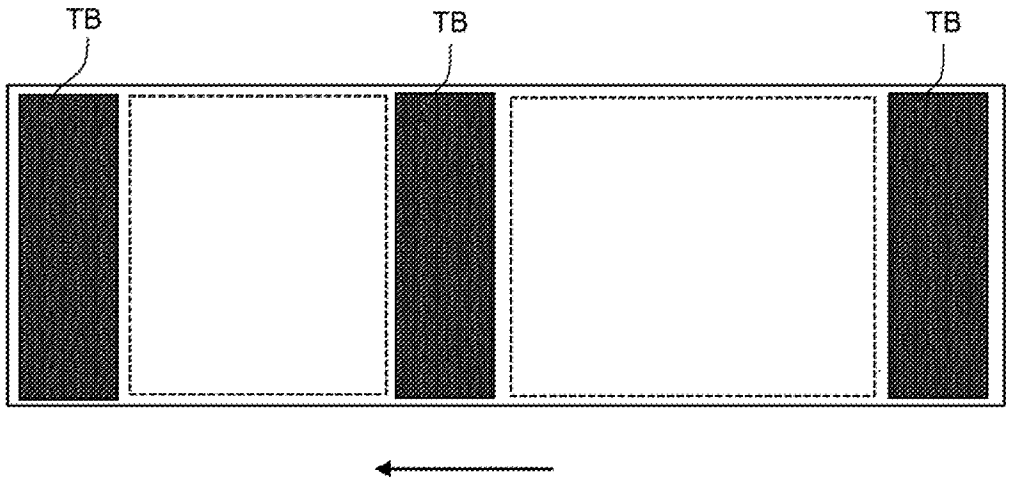
FIG. 5 is a schematic plan view illustrating toner images on a photoconductor drum when toner bands are formed in inter-image zones.
Figure 6:
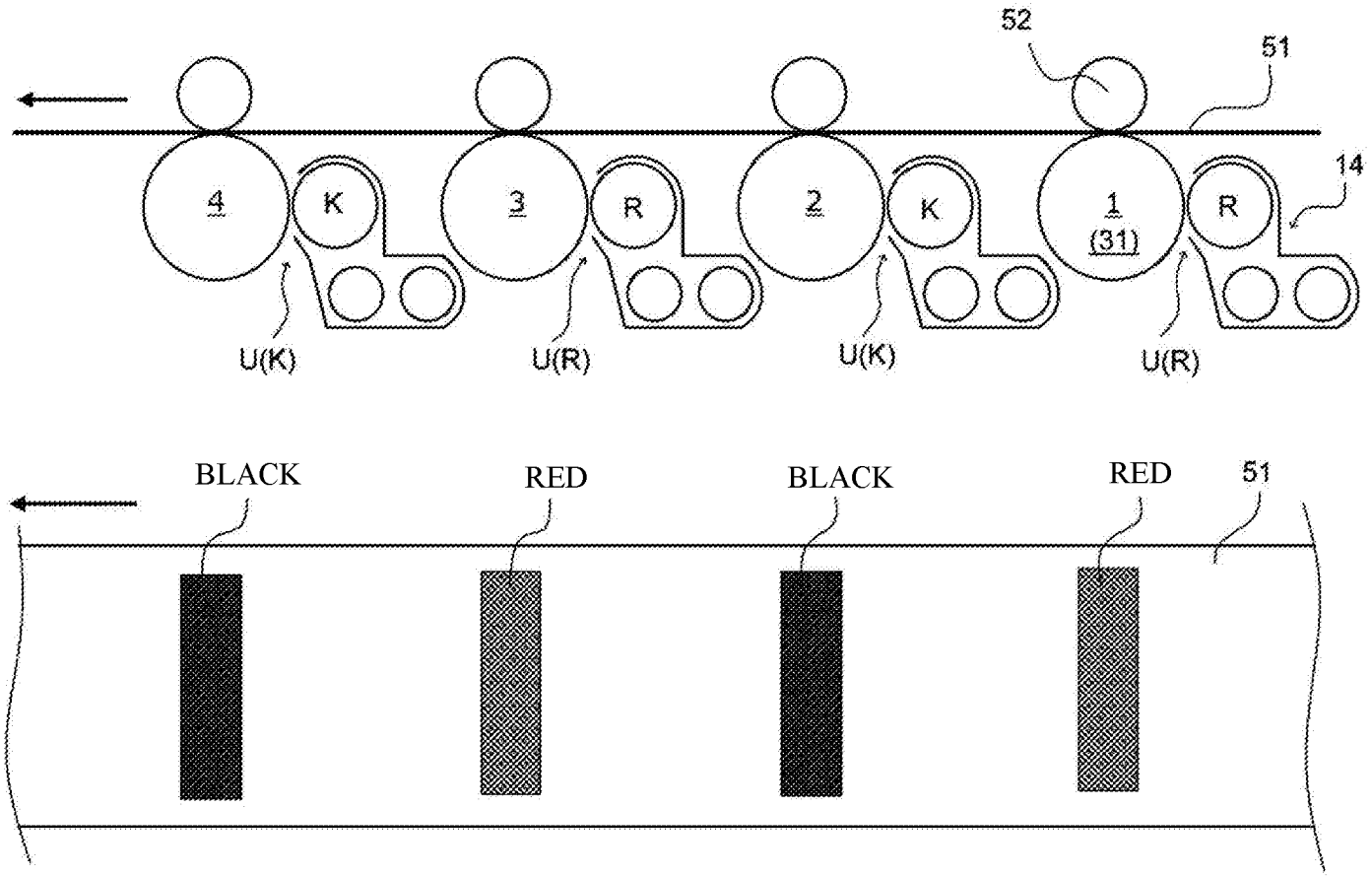
FIG. 6 is a view illustrating an arrangement of image formation engines and toner images on an intermediate transfer belt.
Figure 7:
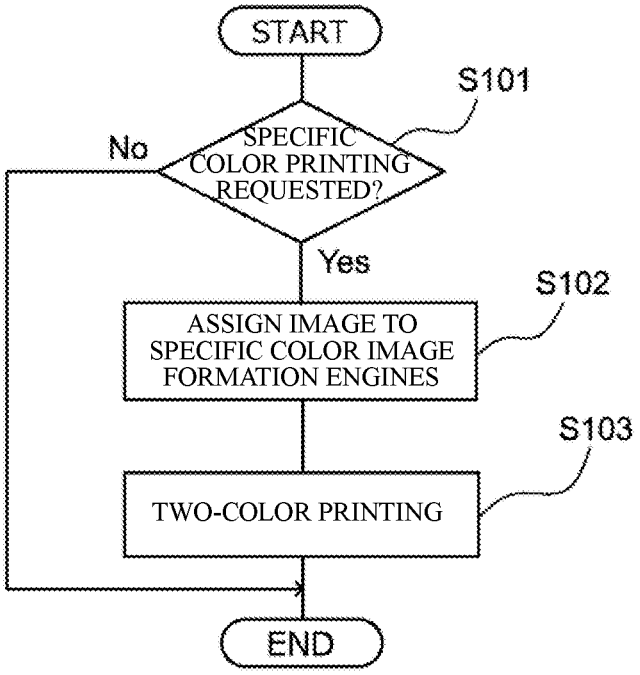
FIG. 7 is a flowchart of the specific color printing.
Figure 16:
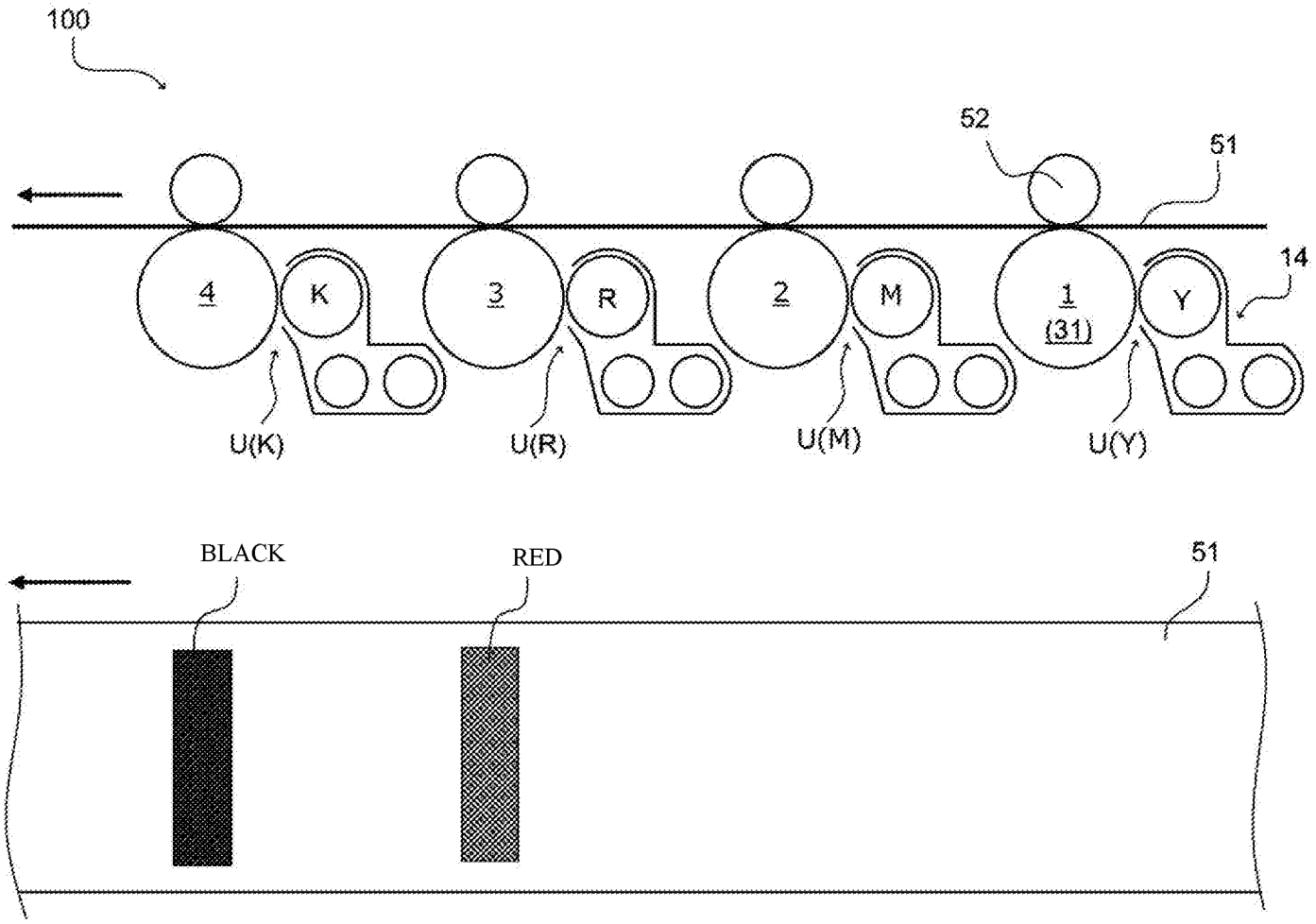
FIG. 16 is a diagram illustrating (i) an arrangement of image formation engines in an image forming apparatus of a comparative example in which one of the image formation engines is a specific color image formation engine, and (ii) toner images on an intermediate transfer belt.

FIG. 3 is a block diagram illustrating an example of a functional configuration of the image forming apparatus 1. FIG. 4 is a diagram illustrating specific color printing. FIG. 5 is a schematic plan view illustrating toner images on the photoconductor drum 31 when toner bands are formed in inter-image zones. FIG. 6 is a view illustrating an arrangement of the image formation engines U and the toner images on the intermediate transfer belt 51. FIG. 7 is a flowchart of the specific color printing. FIG. 16 is a diagram illustrating (i) an arrangement of image formation engines U in an image forming apparatus of a comparative example in which one of the image formation engines is a specific color image formation engine, and (ii) toner images on an intermediate transfer belt 51.

(2.1) Functional Configuration of Control Device

The controller 410 includes an image output control unit 411, a determination unit 412, a toner band control unit 413, a power supply control unit 414, an exposure control unit 415, a fixing temperature control unit 416, and a drive switching control unit 417. The controller 410 controls the overall operation of the image forming apparatus 1 by executing a control program stored in a memory.

The image output control unit 411 gives operation control instructions to the exposure devices 12, the photoconductor units 13, the developing devices 14, the transfer device 15, the fixing device 16, the driving device 17, and the like which are provided in the image forming device 10, as well as controlling exchange of information with the sheet feeding device 20, respectively.

The image output control unit 411 also gives operation control instructions to the power supply control unit 414, the exposure control unit 415, the fixing temperature control unit 416, and the drive switching control unit 417, respectively. That is, the image output control unit 411 determines whether to supply power to the exposure devices 12, the photoconductor units 13, the developing devices 14, the transfer device 15, the fixing device 16, the driving device 17, and the like which constitute the image forming device 10 so as to drive the respective control units, and gives instructions to the respective control units based on the determination results.

Furthermore, the image output control unit 411 exchanges information with the determination unit 412 and the toner band control unit 413. When it is determined that two-color printing is to be performed, the image output control unit 411 performs predetermined operation control.

The determination unit 412 determines whether to perform normal printing or specific color printing, based on a print condition set by a printer driver.

As illustrated in FIG. 4 as an example, the specific color printing refers to printing (i) a two-color image with black and a specific single color or (ii) a monochrome image with a specific single color.

As illustrated in FIG. 5, the toner band control unit 413 forms toner bands TB in non-image areas (that is, inter-image zones IM) on the photoconductor drum 31 at predetermined timings. The non-image area is located between adjacent toner images on the photoconductor drum 31. The toner band TB extends in a direction (that is, a width direction) intersecting a rotational moving direction of the photoconductor drum 31. Forming the toner bands TB in this manner reduces a friction resistance between the photoconductor drum 31 and the cleaning blade 34 and prevents the cleaning blade 34 from being turned up and motor failure of the driving device 17 from occurring.

(2.2) Specific Color Printing

FIG. 16 is the diagram illustrating (i) an image forming apparatus 100 of the comparative example in which one of the image formation engines is the specific color image formation engine and (ii) the toner images on the intermediate transfer belt.

The image forming apparatus 100 includes the four image formation engines arranged along a moving direction of the intermediate transfer belt 51. Among the four image formation engines, a red image formation engine U(R) is disposed at the third position, and a black (K) image formation engine U(K) is disposed at the fourth position. Red is one of specific colors. A yellow (Y) image formation engine U(Y) and a magenta (M) image formation engine U(M) which are used in normal printing are disposed at the first and second positions, respectively.

As described above, when the image forming apparatus 100 in which one of the image formation engines U is the specific color image formation engine U(R) performs the two-color printing using black and the specific color, the image formation engine U(Y) and the image formation engine U(M) are simply driven to rotate but form no toner image.

Therefore, when the number of printed sheets increases, the image formation engine U(Y) and the image formation engine U(M) which have consumed no toner (that is, have developed no image) form the toner bands TB on the photoconductor drum 31 as illustrated in FIG. 5 in order to reduce the frictional resistance between the photosensitive drums 31 and the cleaning blades 34 and to prevent the cleaning blades from being turned up and prevent the motor failure of the driving device 17 from occurring. Forming the toner bands TB by the image formation engine U(Y) and the image formation engine U(M) consumes toner that does not contribute to image formation from the viewpoint of the two-color printing and may increase a printing cost.

The image forming apparatus 1 according to the present exemplary embodiment includes the plural image formation engines U accommodating the developer of the same color. The controller 410 controls the image formation engines U to form images of one color. The controller 410 is an example of a controller.

FIG. 6 illustrates the image forming apparatus 1 including red image formation engines U(R) disposed at the first and third positions and black image formation engines U(K) disposed at the second and fourth positions. Red is one of the specific colors.

The determination unit 412 determines whether to perform the normal printing or the specific color printing, based on the print condition set by the printer driver (S101). When to perform the specific color printing (Yes at S101), the image output control unit 411 instructs the image processor 420 to assign an image to the specific color image formation engines U (S102).

Then, the image output control unit 411 drives and rotates all of the first and third image formation engines U(R) and the second and fourth image formation engines U(K) via the drive switching control unit 417, so as to perform the specific color printing (S103). Specifically, the two-color printing is performed using red and black.

Since the image of the one color is formed using the plural image formation engines U accommodating the developer of the same color in the above described manner, all the image formation engines U form the toner images, so that toner consumed in the toner bands TB for preventing the cleaning blades from being turned up and preventing the motor failure of the driving device 17 from occurring can be reduced.

Example 1

Figure 8:
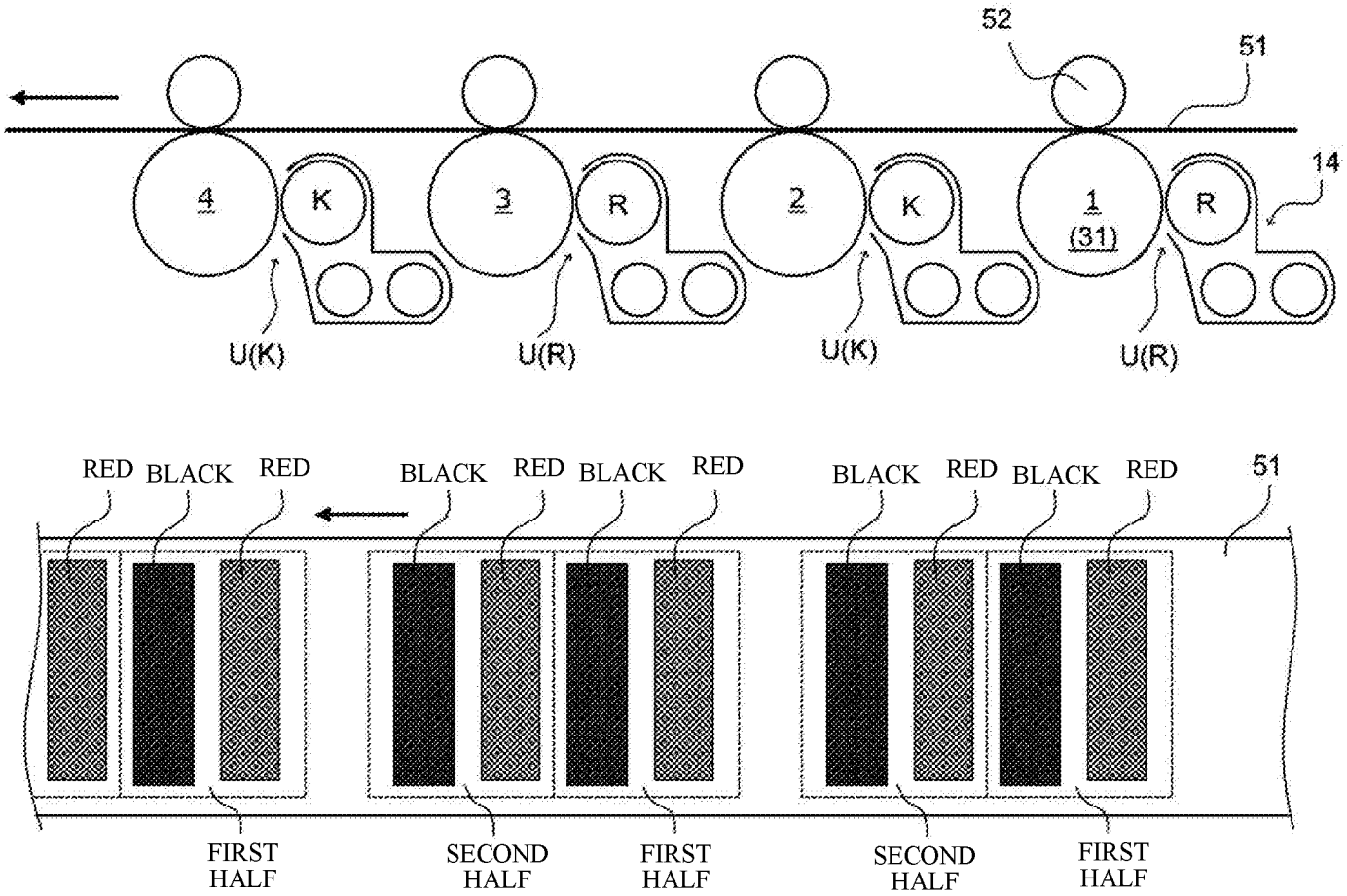
FIG. 8 is a diagram illustrating an arrangement of image formation engines in an image forming apparatus according to an example 1 and a print image.
Figure 9:
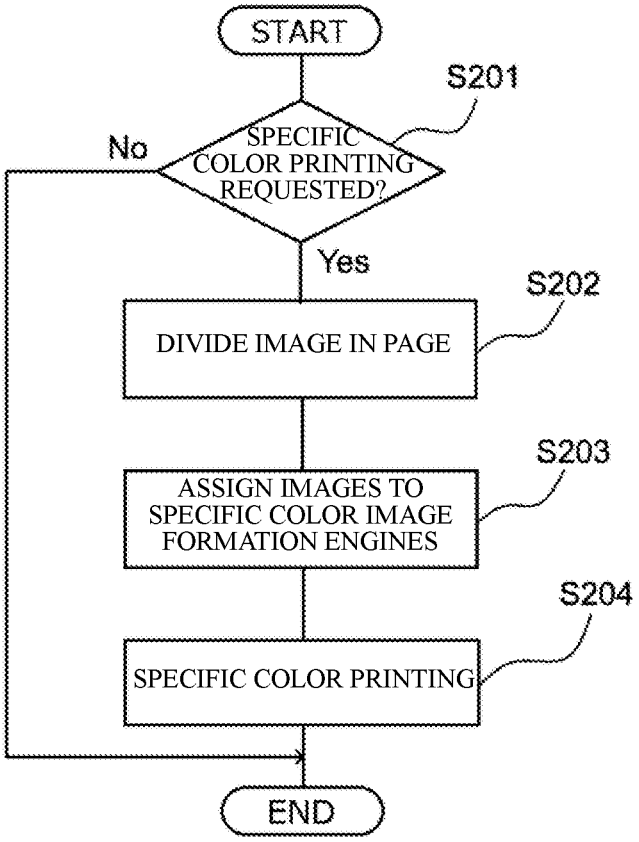
FIG. 9 is a flowchart of specific color printing of the example 1.

FIG. 8 is a diagram illustrating the arrangement of the image formation engines U in the image forming apparatus 1 according to an example 1 and a print image. FIG. 9 is a flowchart of a specific color printing of the example 1.

The determination unit 412 determines whether to perform the normal printing or the specific color printing, based on the print condition set by the printer driver (S201). When to perform the specific color printing (Yes at S201), the image output control unit 411 instructs the image processor 420 to divide an image into a first half and a second half in a page as illustrated in FIG. 8 (S202) and to assign the divided images to the specific color image formation engines U (S203).

Then, the image output control unit 411 drives and rotates all of the first and third image formation engines U(R) and the second and fourth image formation engines U(K) via the drive switching control unit 417, so as to perform the specific color printing (S204).

Example 2

Figure 10:
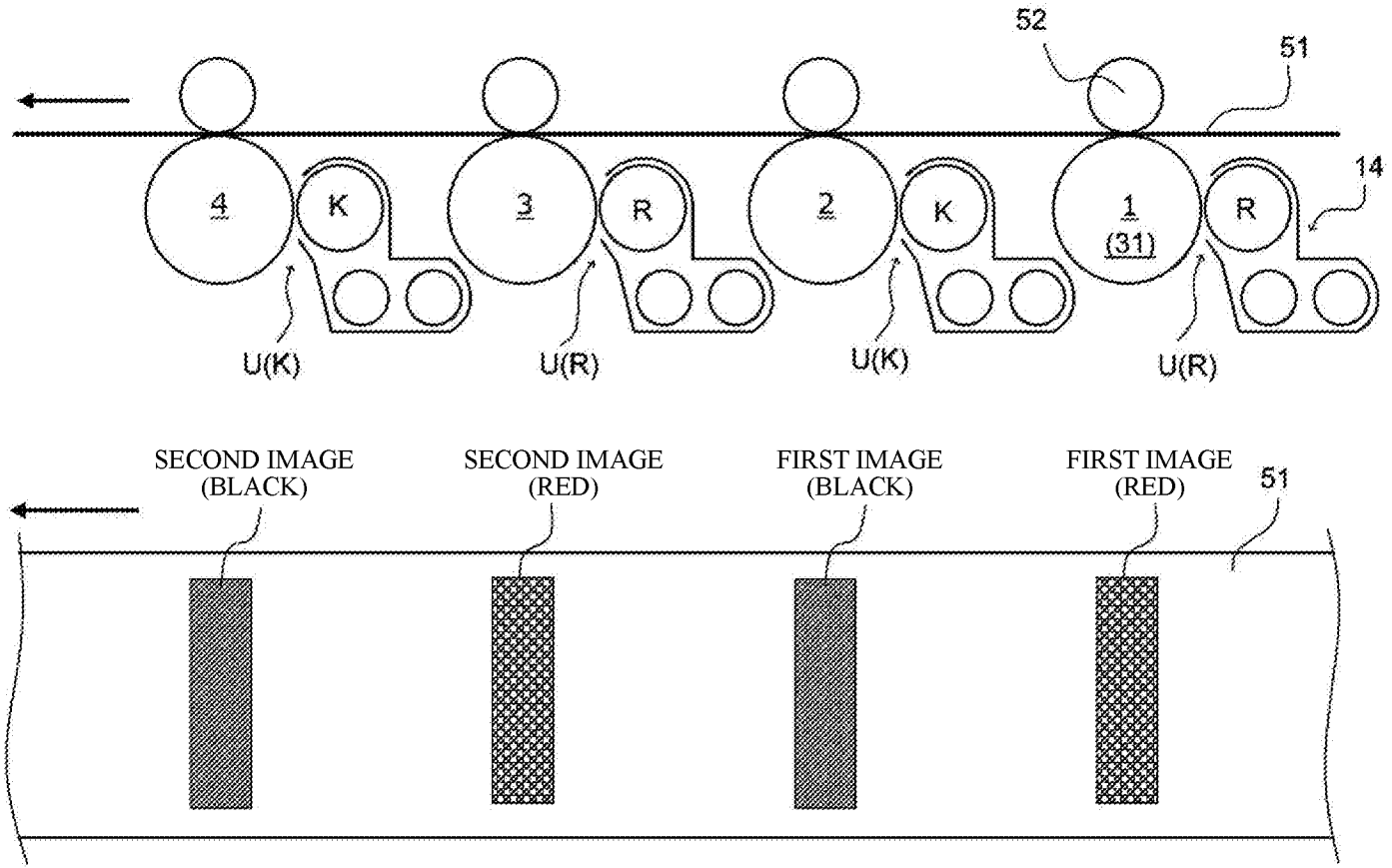
FIG. 10 is a view illustrating an arrangement of image formation engines in an image forming apparatus according to an example 2 and toner images on an intermediate transfer belt.
Figure 11:
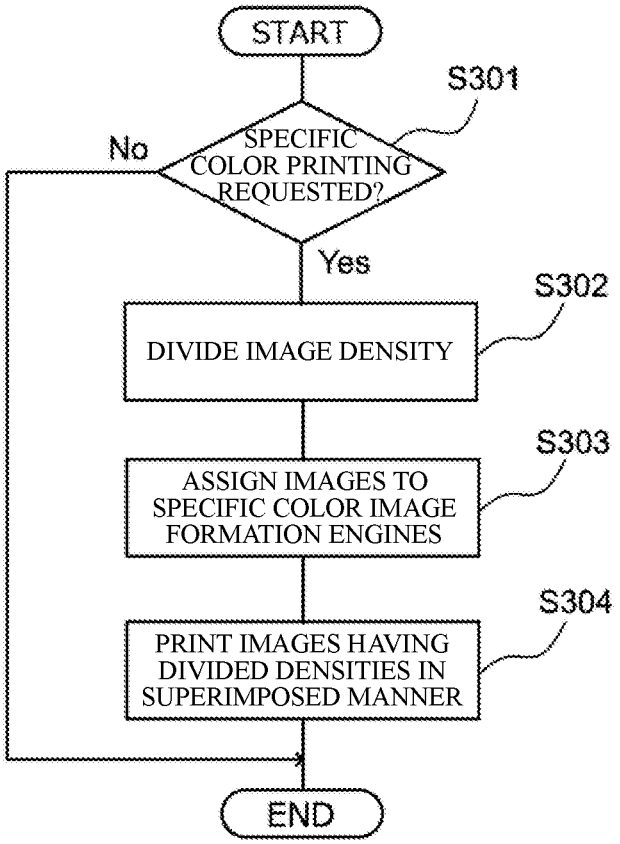
FIG. 11 is a flowchart of specific color printing of the example 2.

FIG. 10 is a view illustrating the arrangement of the image formation engines U in the image forming apparatus 1 according to an example 2 and toner images on the intermediate transfer belt 51. FIG. 11 is a flowchart of a specific color printing of the example 2.

The determination unit 412 determines whether to perform the normal printing or the specific color printing, based on the print condition set by the printer driver (S301). When to perform the specific color printing (Yes at S301), the image output control unit 411 instructs the image processor 420 to divide an image into a first image and a second image which have different densities from each other such that an image obtained by superimposing the image to be formed has a predetermined density as shown in FIG. 10 (S302) and assign the first image and the second image to the specific color image formation engines U (S303).

Then, the image output control unit 411 drives and rotates all of the first and third image formation engines U(R) and the second and fourth image formation engines U(K) via the drive switching control unit 417, to perform the specific color printing such that the first image and the second image assigned to the respective image formation units U are superimposed (S304). As a result, all the image formation engines U form the toner images, so that toner consumed in the toner bands TB for preventing the cleaning blade from being turned up and preventing the motor failure of the driving device 17 from occurring can be reduced.

Modification 1

Figure 12:
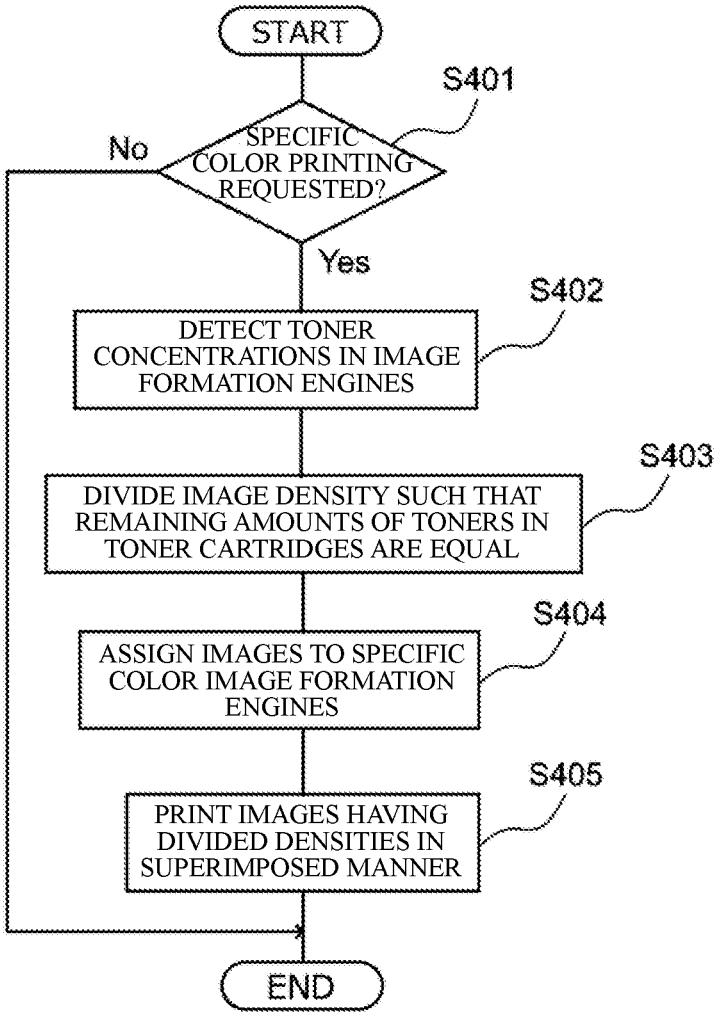
FIG. 12 is a flowchart of specific color printing according to a modification 1.

FIG. 12 is a flowchart of specific color printing according to a modification 1.

The determination unit 412 determines whether to perform the normal printing or the specific color printing, based on the print condition set by the printer driver (S401). When to perform the specific color printing (Yes at S401), the image output control unit 411 acquires amounts of remaining toners from the toner remaining amount sensors SR of the toner cartridges TC (S402).

Then, the image output control unit 411 instructs the image processor 420 to divide an image to be formed into a first image and a second image that have different densities from each other such that the remaining toner amounts of toners in the toner cartridges TC which supply the toners to the image formation engines U are equal to each other (S403) and to assign the first image and the second image to the specific color image formation engines U (S404).

Then, the image output control unit 411 drives and rotates all of the first and third image formation engines U(R) and the second and fourth image formation engines U(K) via the drive switching control unit 417, to perform the specific color printing such that the first image and the second image assigned to the respective image formation units U are superimposed (S405). Accordingly, all of the image formation engines U form the toner images, so that toner consumed in the toner bands TB for preventing the cleaning blade from being turned up and preventing the motor failure of the driving device 17 from occurring can reduced, and replacement timing at which the toner cartridges TC that supply the toners to the image formation engines are to be replaced can be made uniform.

Modification 2

Figure 13:
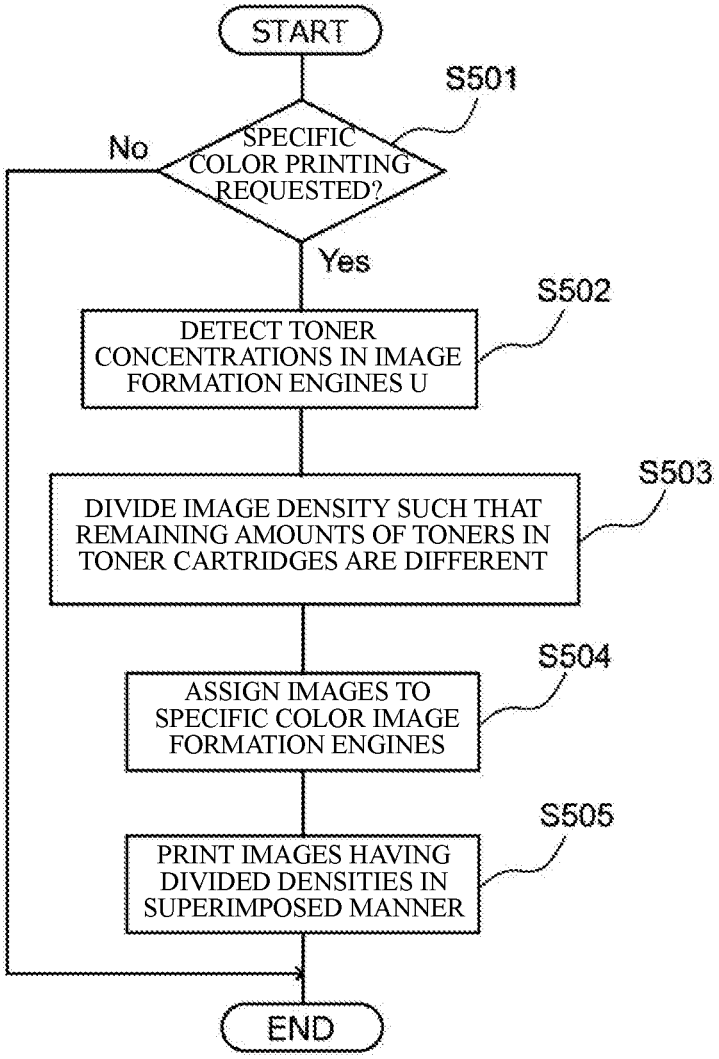
FIG. 13 is a flowchart of specific color printing according to a modification 2.

FIG. 13 is a flowchart of specific color printing according to a modification 2.

The determination unit 412 determines whether to perform the normal printing or the specific color printing, based on the print condition set by the printer driver (S501). When to perform the specific color printing (Yes at S501), the image output control unit 411 acquires the remaining amounts of toners from the toner remaining amount sensors SR of the toner cartridges TC (S502).

Then, the image output control unit 411 instructs the image processor 420 to divide an image to be formed into a first image and a second image that have different densities from each other such that the remaining toner amounts of toners in the toner cartridges TC which supply the toners to the image formation engines U are different from each other (S503) and to assign the first image and the second image to the specific color image formation engines U (S504).

Then, the image output control unit 411 drives and rotates all of the first and third image formation engines U(R) and the second and fourth image formation engines U(K) via the drive switching control unit 417, to perform the specific color printing such that the first image and the second image assigned to the respective image formation units U are superimposed (S505). Accordingly, all of the image formation engines U form the toner images, so that toner consumed in the toner bands TB for preventing the cleaning blade from being turned up and preventing the motor failure of the driving device 17 from occurring can be reduced, and replacement timing at which the toner cartridges TC that supply the toner to the image formation engines U are to be replaced can be made different, which reduces a down time of the image forming apparatus 1.

Example 3

Figure 14:
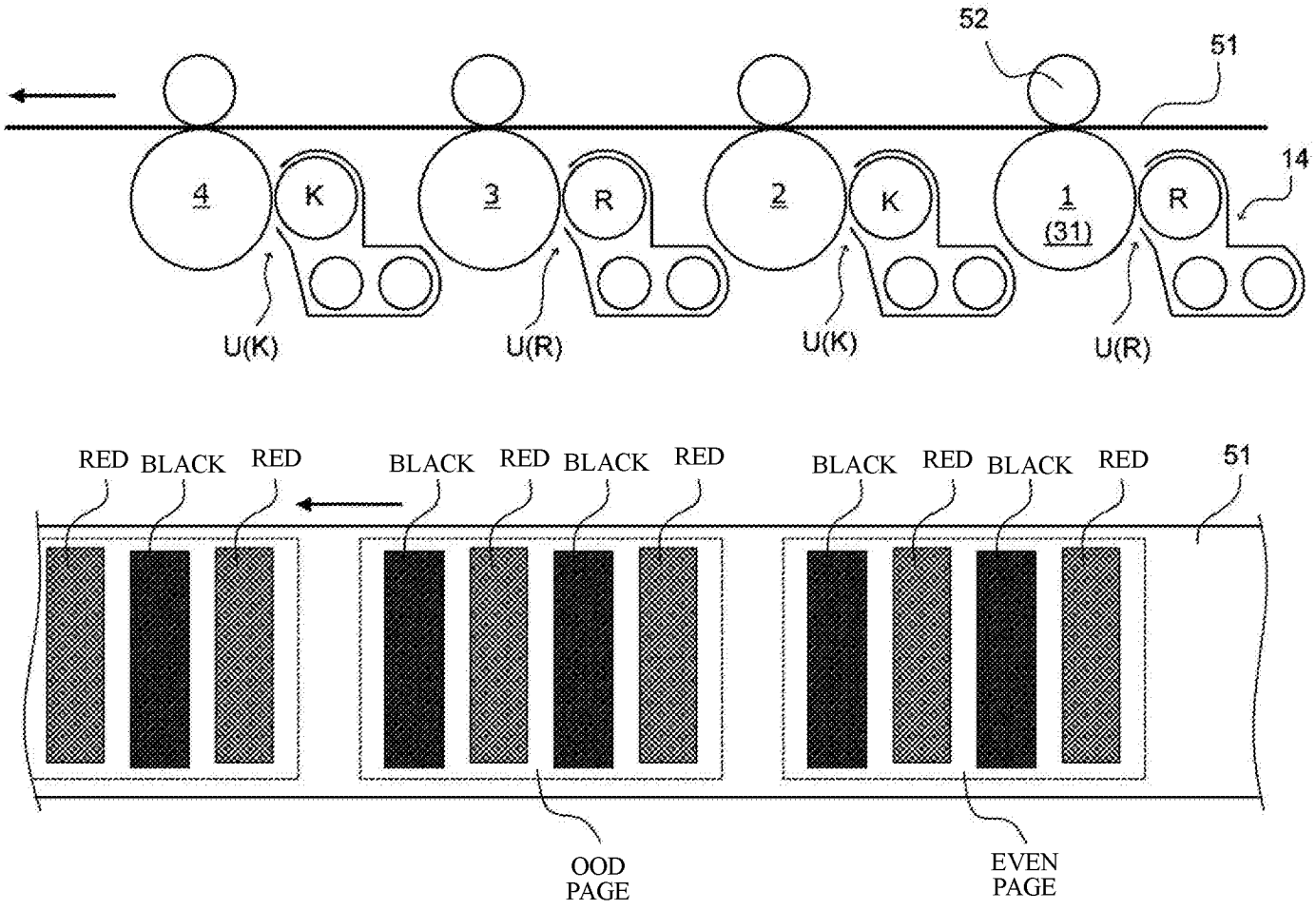
FIG. 14 is a view illustrating an arrangement of image formation engines in an image forming apparatus according to an example 3 and toner images on an intermediate transfer belt.
Figure 15:
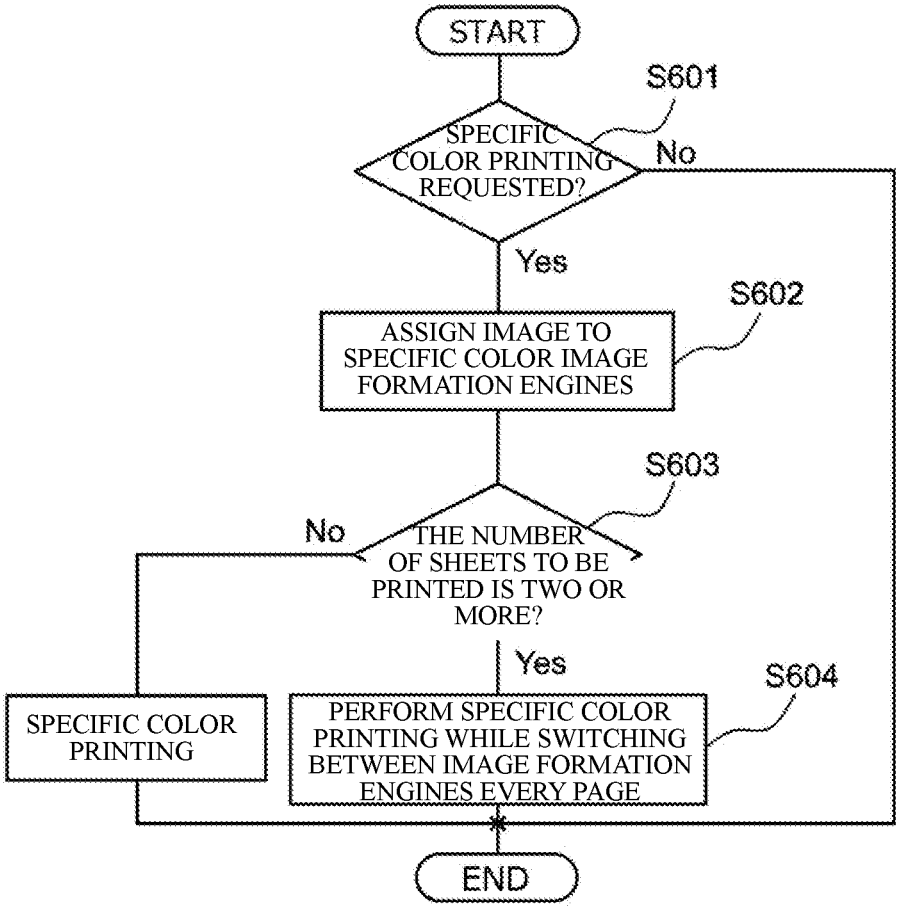
FIG. 15 is a flowchart of specific color printing of the example 3.

FIG. 14 is a view illustrating the arrangement of the image formation engines U in the image forming apparatus 1 according to an example 3 and toner images on the intermediate transfer belt 51. FIG. 15 is a flowchart of the specific color printing of the example 3.

The determination unit 412 determines whether to perform the normal printing or the specific color printing, based on the print condition set by the printer driver (S601). When to perform the specific color printing (Yes at S601), the image output control unit 411 instructs the image processor 420 to assign an image to the specific color image formation engines U (S602).

Next, the image output control unit 411 determines if the number of sheets to be printed is two or more (S603). When the number of sheets to be printed is two or more (Yes at S603), the image output control unit 411 switches between the first and third image formation engines U(R) and between the second and fourth image formation engines U(K) every page via the drive switching control unit 417 (S604), so as to perform the specific color printing.

Accordingly, images in a print job are formed using all of the plural image formation engines U accommodating the developer of the same color while switching between the image formation engines U every page, so that toner consumed in the toner bands TB for preventing the cleaning blade from being turned up and preventing the motor failure of the driving device 17 from occurring can be reduced.

The exemplary embodiment of the present disclosure have been described in detail. The present disclosure is not limited to the above exemplary embodiment. Various modifications may be made within the scope of the gist of the present disclosure recited in the appended claims.

In the present exemplary embodiment, the tandem color image forming apparatus including the plural developing devices 14 accommodating the developer containing a colorant and a carrier has been described as a printing apparatus. It is noted that the printing apparatus is not limited thereto. For example, an inkjet image forming apparatus including plural ink cartridges may be controlled such that an image of one color is formed using plural inkjet heads accommodating ink of the same color, so that ink ejection for preventing the ink from being clogged up can be reduced, and ink consumption can be reduced.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A printing apparatus comprising:

a plurality of image forming units accommodating colorants of the same color and each having:

an intermediate transfer belt configured to form an image with the colorants; and an amount sensor configured to detect a remaining amount of colorants; and a controller configured to form an image of one color using the plurality of image forming units by:

receiving remaining amounts of the colorants from each of the plurality of image forming units;

dividing the image of the one color into images having different densities from each other such that a superimposed image of the images has a predetermined density and the remaining amounts of the colorants in the plurality of image forming units will be equal to each other; and instructing the plurality of image forming units to form the images.

2. The printing apparatus according to claim 1, wherein the controller is configured to:

divide the image of the one color in a page into sub-images; and instruct the plurality of image forming units to form the sub-images.

3. The printing apparatus according to claim 1, wherein the controller is configured to instruct a different image forming unit among the plurality of image forming units for every page, to execute a print job.

4. The printing apparatus according to claim 1, wherein the colorants of the same color include a special color other than yellow, magenta, cyan, and black.

5. A printing apparatus comprising:

a plurality of image forming units accommodating colorants of the same color and each having:

an intermediate transfer belt configured to form an image with the colorants; and an amount sensor configured to detect a remaining amount of colorants; and a controller configured to cause all of the plurality of image forming units to form an image of one color by:

receiving remaining amounts of the colorants from each of the plurality of image forming units;

dividing the image of the one color into images having different densities from each other such that a superimposed image of the images has a predetermined density and the remaining amounts of the colorants in the plurality of image forming units will be equal to each other; and instructing the plurality of image forming units to form the images.

6. The printing apparatus according to claim 5, further comprising:

a switching unit that selectively switches the plurality of image forming units into rotational driving, wherein all of the plurality of image forming units are rotationally driven to form the image of the one color.

7. The printing apparatus according to claim 5, wherein the controller is configured to:

divide the image of the one color in a page into sub-images; and instruct the plurality of image forming units to form the sub-images.

8. The printing apparatus according to claim 6, wherein the controller is configured to:

divide the image of the one color in a page into sub-images; and instruct the plurality of image forming units to form the sub-images.

* * * * *